United States Patent [19]

Falomo

[11] 4,311,379

[45] Jan. 19, 1982

[54] DEVICE FOR THE SIMULTANEOUS MULTIPLE TRANSFER OF PHOTOGRAPHIC PAPER IN STRIP FORM, FROM ROLL-HOLDER CASSETTES TO DEVELOPERS

[75] Inventor: Lodovico Falomo, Orcenigo Inferiore, Italy

[73] Assignee: Barzano & Zanardo, Milan, Italy

[21] Appl. No.: 115,383

[22] Filed: Jan. 25, 1980

[30] Foreign Application Priority Data

Jan. 29, 1979 [IT] Italy ..... 20640/79[U]

[51] Int. Cl.[3] ..... G03D 3/08

[52] U.S. Cl. ..... 354/313; 354/319; 271/9

[58] Field of Search ..... 354/307, 310, 311, 312, 354/313, 314, 316, 277, 319; 271/9, 184, 186, 225

[56] References Cited

U.S. PATENT DOCUMENTS

| | | | |
|---|---|---|---|
| 2,732,779 | 1/1956 | Beard et al. | 354/307 |
| 3,720,408 | 3/1973 | Horn | 354/319 |
| 3,776,110 | 12/1973 | Clayton | 354/307 |
| 3,879,030 | 4/1975 | Hommerin | 354/319 |
| 4,067,034 | 1/1978 | Kwiatkowski | 354/310 |
| 4,094,726 | 6/1978 | Hujer et al. | 354/313 |
| 4,164,371 | 8/1979 | Viehrig et al. | 354/307 |

*Primary Examiner*—L. T. Hix
*Assistant Examiner*—Alan Mathews
*Attorney, Agent, or Firm*—Cushman, Darby & Cushman

[57] ABSTRACT

A transfer unit for exposed photographic paper webs to be conveyed to a developer has a generally prismatic outline and is equipped with a front slot and two side slots which extend in the shape of deflecting aprons so as to turn the paper web upside down prior to its entering the developer tub.

2 Claims, 6 Drawing Figures

DEVICE FOR THE SIMULTANEOUS MULTIPLE TRANSFER OF PHOTOGRAPHIC PAPER IN STRIP FORM, FROM ROLL-HOLDER CASSETTES TO DEVELOPERS

The present invention relates to a device adapted to transfer exposed photographic paper in strip form simultaneously from one or more roll-holder cassettes to the developers.

In the field of photographic developing and printing at industrial level, the great number of photographic copies requiring to be printed in a short period of time makes it necessary to employ photographic paper in rolls, which also means that a large number of prints can be contained within a relatively small space.

In the delicate phase of transporting said rolls of exposed photographic paper to the developing section, use is made of light-proof cassettes. Each cassette is brought close to and caused to adhere to a device which takes up the paper and transfers it to the developing station, preventing the said paper from being exposed to the light. It will be clear from the foregoing that, if it is wished to feed into the developing chamber rolls of exposed paper contained in cassettes of different types or makes, it is necessary to have several devices in side-by-side arrangement to perform said take-off and multiple transfer.

It has in fact to be recalled that roll-holder cassettes are frequently of different types, and thus to the problem of multiple feeding into the developing chamber there is added the problem of having available feeding means adapted to take up the various kinds of roll-holder cassettes existing on the market. Clearly, the plurality of devices for the simultaneous takeoff and treatment of strips of photographic paper from roll-holder cassettes of various types entails cost and space problems which would be noticeably reduced by the use of a single device adapted to perform this simultaneous multiple operation.

For the take-off and simultaneous entrainment of various strips of photographic material in sheet-form, the device would in theory call for a width exactly equal to the sum of the widths of the said strips. However, if it is borne in mind that the known devices provide for a frontal approach of the roll-holder cassettes, i.e. frontally to the line of conveyance, it is evident that the required width of a device must be equal to the multiple of the width of the cassette—necessarily not a little greater than the width of the roll—and the device would therefore come to have prohibitively large dimensions.

The object of the present invention is consequently to embody a single device of relatively small dimensions, adapted to transfer photographic paper in strips simultaneously from several cassettes of various types to the developers.

This object is achieved by means of a device consisting of a chamber which may be in the form of a parallelepiped, in the walls of which are formed light-proof slots, within which run conveyor belts moved by rollers which are operated by a motor, characterized by the fact that one of the slots is in a frontal position and two of the slots are in a lateral position, symmetrically with the longitudinal axis of the prism and extending as angular (90°) deflecting aprons, and also characterized by the fact that on the three walls there are provided take-up abutment and support means adapted to receive cassettes of various types which contain rolls of photographic paper.

The peculiarities of the device embodied according to the invention will be more easily comprehended from one of its exemplifying embodiments as illustrated in the attached drawings, in which.

Figure 1:
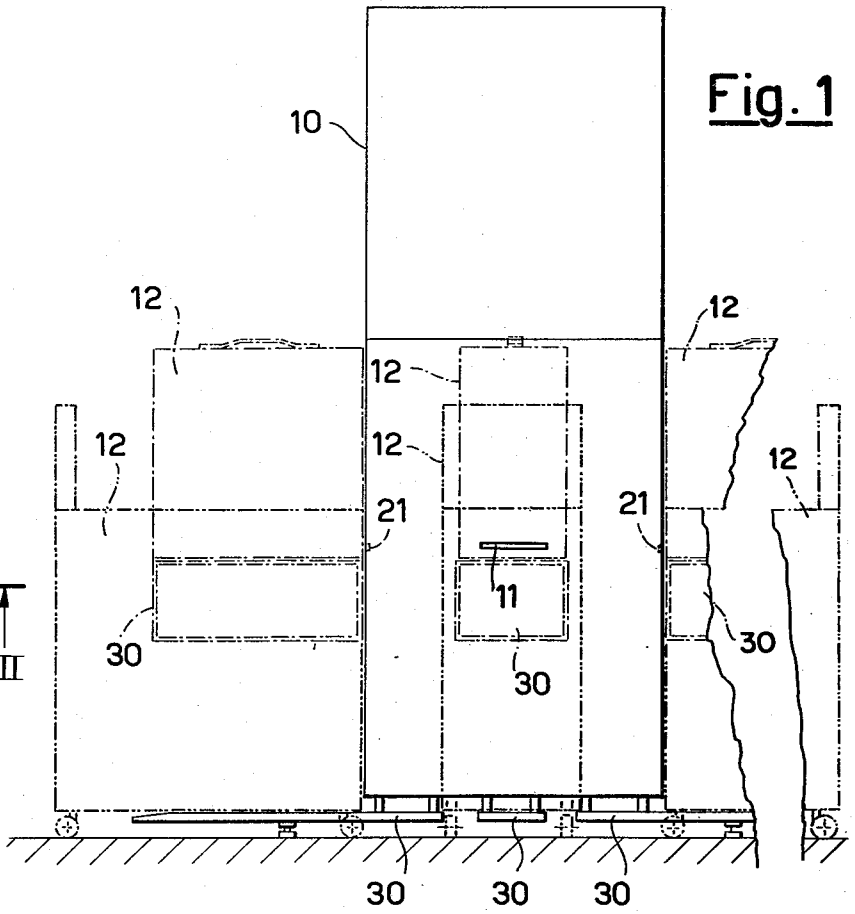
FIG. 1 is a diagrammatical front view of a device according to the invention.
Figure 2:
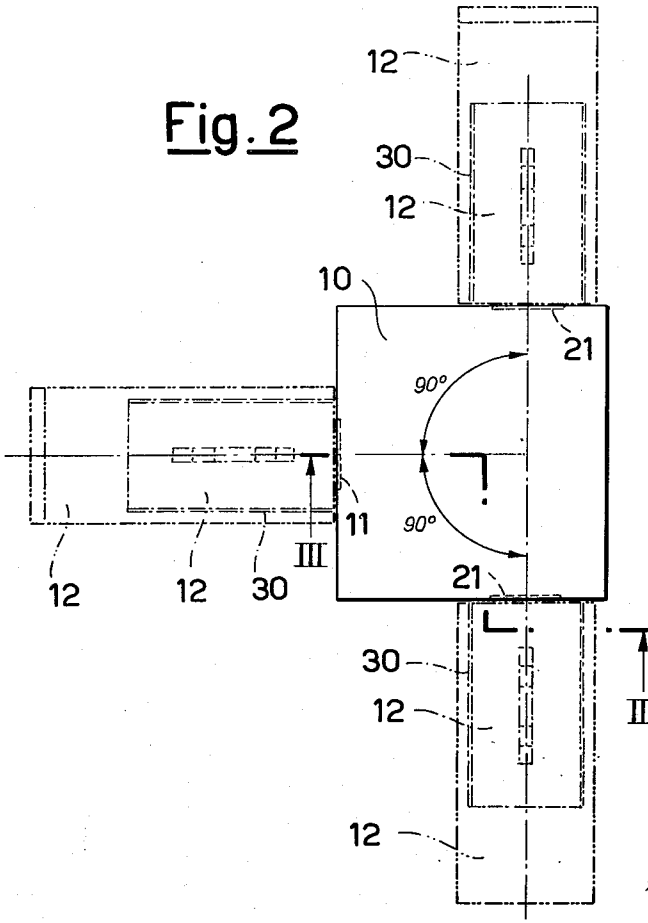
FIG. 2 is a diagrammatical plan view of the device of FIG. 1.
Figure 3:
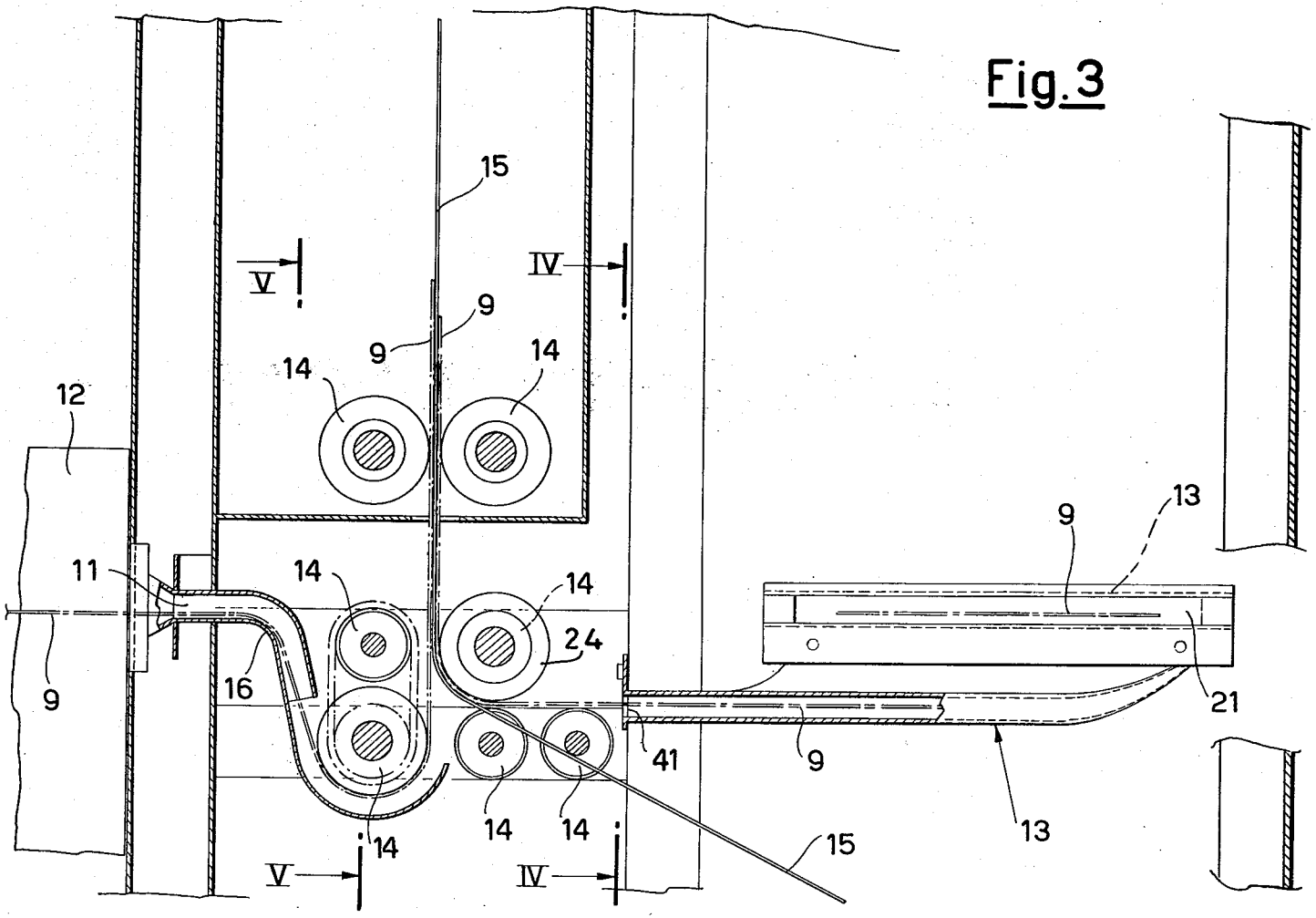
FIG. 3 is a partially cross-sectional view, taken along the line III—III of FIG. 2.
Figure 4:
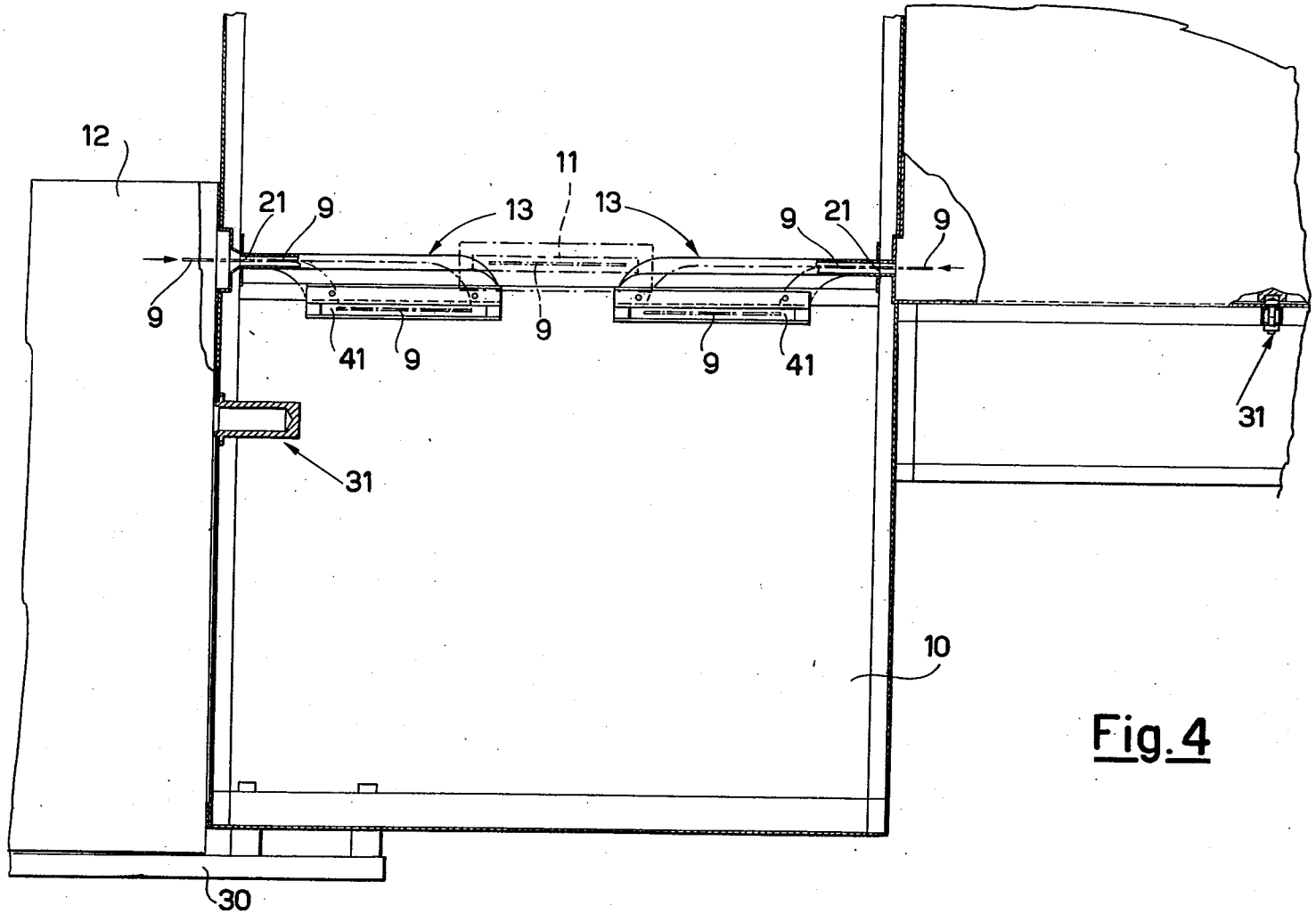
FIG. 4 is a partial diagrammatical view, taken along the line IV—IV of FIG. 3.

As a non-limiting example a device 10 consists of a chamber in the form of a parallelepiped on the walls of which are formed a central entry-slot 11 and two lateral entry-slots 21 which are at right angles to the slot 11 and symmetrical with respect to the longitudinal axis of the prism. To the three walls there can be approached to the point of adhering thereto, roll-holder cassettes 12 of which the apertures for the passage of strips 9 of paper match up in a light-proof manner with the slots 11 or 21. Since, as has been stated, the roll-holder cassettes available on the market are of various types, provision is made for support and alignment surfaces as at 30 and abutments as at 31 which allow the various makes of cassettes to be adapted in a simple manner to the device forming subject matter of the invention.

Figure 6:
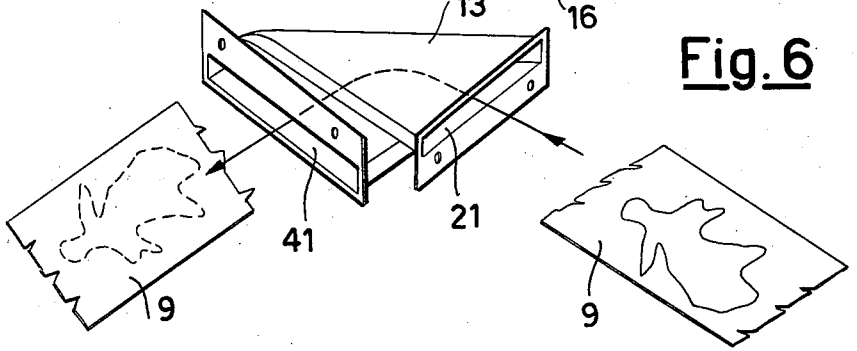
FIG. 6 is a perspective view of an angular (90°) deflecting aprons.

The slot 11 extends internally as a guide channel 16, while the slots 21 extend internally as angular (90°) deflecting aprons 13 with outlet slots 41. As shown in FIG. 6, the said deflecting aprons have the purpose of deviating the strips of exposed photographic paper from a certain direction into a direction at right angles to the first direction and also have the simultaneous purpose of upturning the side of the emulsion. In the present embodiment the said deflecting aprons find application inasmuch as they bring the laterally loaded strips of paper onto the same plane of movement as the frontally loaded strip of paper. The said strips of paper are guided by rollers 14 and are urged towards the developers by take-up devices—not illustrated—in turn fixed to conveyor belts 15 which wind up on motor-driven rollers 24; this conveyor device is not here described in detail as it is in se conventional in this type of apparatus.

Figure 5:
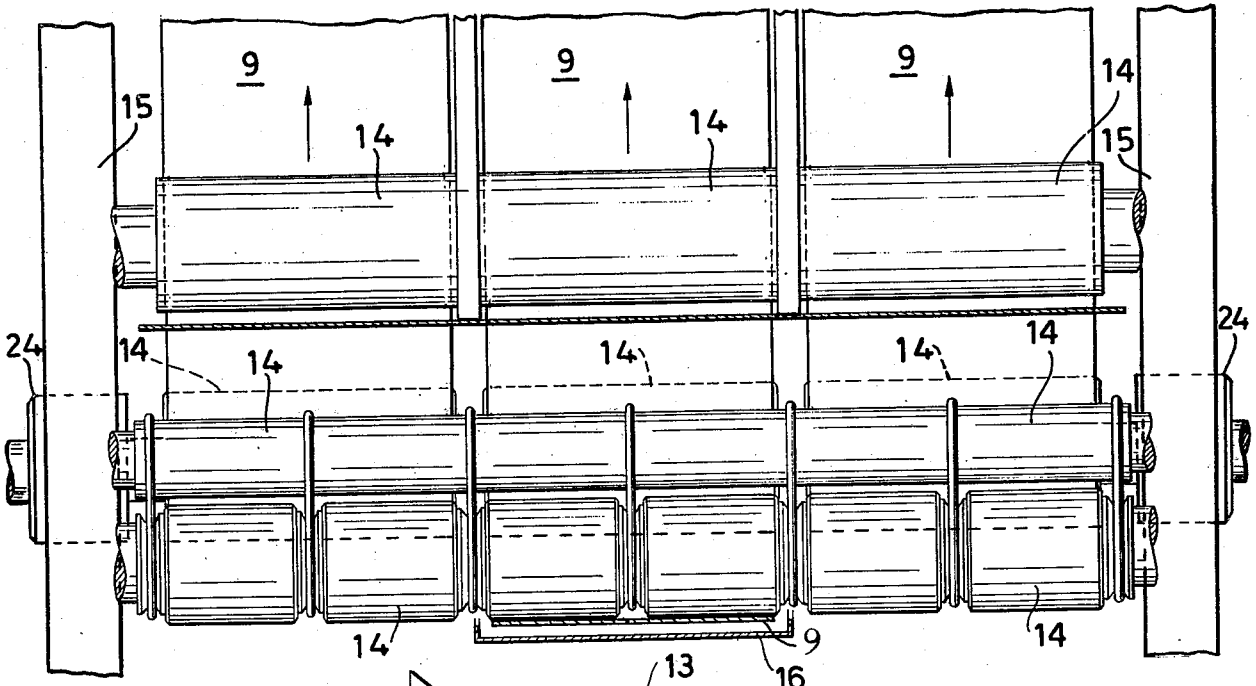
FIG. 5 is a cross-sectional view, taken along the line V—V of FIG. 3.

FIG. 5 shows the subdivision of the strips of paper into one central strip and two lateral strips costing respectively from the guide 16 and from the deflecting aprons 13. In practice, independently of whether the entry area is central or lateral, the strips of paper move within the chamber on one and the same plane, then to be canalized by the conveyor belts 15, by means of the previously mentioned take-up devices, towards the developers.

As what has been described above is, as has been stated, a non-limiting example of embodiment, variants thereof and additions thereto can be made without going beyond the scope of the invention.

For example, the dimensions are not limiting, and the width of the slots and rollers can be varied to receive and convey photographic paper larger than the normal format used industrially. Further, with use of the same principle of take-up and transfer, the number of central and lateral slots can be increased and the system for conveying the paper can be appropriately sized in order to obtain a device adapted to receive more than three roll-holder cassettes.

I claim:

1. A device for transferring exposed photographic paper in strip form from a plurality of roll-holder cassettes, said device comprising walls defining a chamber, said walls having a light-proof frontal slot and two lateral light-proof slots which are symmetrical with respect to the longitudinal axis of the chamber, an internal deflecting apron adjacent each lateral slot shaped so as to deflect a moving strip of photographic paper 90° and simultaneously to turn the moving strip upside-down, means for mounting a cassette containing photographic paper to each wall in which a slot is located, and transport means in said chamber for transporting strips of photographic paper.

2. A device as in claim 1 wherein said internal deflecting aprons are arranged so as to deflect their respective strips into side-by-side relationship in a common plane, said device also including guide means associated with said frontal slot for guiding a strip passing through that slot into said common plane.

* * * * *

UNITED STATES PATENT AND TRADEMARK OFFICE

CERTIFICATE OF CORRECTION

PATENT NO. : 4,311,379

DATED : January 19, 1982

INVENTOR(S) : Lodovico Falomo

It is certified that error appears in the above—identified patent and that said Letters Patent is hereby corrected as shown below:

On front page format:

Paragraph [73] should be blank, as there is no assignee.

Signed and Sealed this

*Twenty-ninth* Day of *June 1982*

[SEAL]

*Attest:*

*Attesting Officer*

GERALD J. MOSSINGHOFF

*Commissioner of Patents and Trademarks*